US005887810A

United States Patent [19]

Maruyama

[11] Patent Number: 5,887,810

[45] Date of Patent: Mar. 30, 1999

[54] CRUSHER OF CHUNKS OF CONCRETE OR MASONRY

[75] Inventor: Mitsuru Maruyama, Tokyo, Japan

[73] Assignee: Maruyama Corporation, Tokyo, Japan

[21] Appl. No.: 935,327

[22] Filed: Sep. 22, 1997

[51] Int. Cl.[6] ..... B02C 13/02; B02C 13/20

[52] U.S. Cl. ..... 241/189.1; 241/191; 241/236

[58] Field of Search ..... 241/101.72, 189.1, 241/236, 191, 190

[56] References Cited

U.S. PATENT DOCUMENTS

| | | | |
|---|---|---|---|
| 4,385,732 | 5/1983 | Williams | 241/167 |
| 5,160,095 | 11/1992 | Pepper | 241/46.06 |
| 5,201,475 | 4/1993 | Nakagomi | 241/236 |
| 5,355,918 | 10/1994 | Lang | 241/101.7 X |
| 5,405,092 | 4/1995 | Jonninen | 241/27 |
| 5,431,350 | 7/1995 | Purser | 241/101.72 |
| 5,562,257 | 10/1996 | Graveman et al. | 241/190 |
| 5,598,981 | 2/1997 | Hellmich | 241/189.1 |

*Primary Examiner*—John M. Husar
*Attorney, Agent, or Firm*—Rodman & Rodman

[57] ABSTRACT

The present invention relates to a crusher capable of efficiently crushing chunks of concrete or masonry waste, which crusher is attached to a crusher body such as a bucket which is disposed at a distal end of a movable arm or other predetermined place of a civil engineering machine, into small pieces. A pair of toothed crushing plates each having a plurality of radially extending teeth are attached to eccentric shafts mounted on the crusher body.

13 Claims, 15 Drawing Sheets

CRUSHER OF CHUNKS OF CONCRETE OR MASONRY

BACKGROUND OF THE INVENTION

In civil engineering machines, there is one having a movable arm removably attached to a distal end thereof with a bucket or other attachments which can be selectively used in accordance with necessity. An operator sitting in a cabin operates the movable arm in operation.

The present invention uses a crusher, as the above-mentioned attachment, capable of crushing a large piece of concrete waste, etc. into a prescribed size or smaller so as to be suitable for transportation. Particularly, the present invention relates to a unique idea of crushing toothed wheel (toothed gear) of the crusher.

Conventional toothed wheels perform a primary crushing and a secondary crushing separately. First, a large chunk of concrete is primarily crushed with a pair of rotational members each having teeth capable of crushing an object roughly and then sent to another pair of rotational members each having teeth capable of secondarily crushing an object into small pieces. This means that the object is required to be crushed twice according to the conventional technique.

SUMMARY OF THE INVENTION

It is, therefore, an object of the present invention to provide a crusher capable of crushing a large chunk of concrete or the like into small enough pieces to be transported directly, by one action and without a need of crushing the object twice as in the prior art.

To achieve the above object, according to the present invention, there is essentially provided a crusher of chunks of waste in which one pair of crushing toothed plates each provided with at least three projecting arcuate teeth arranged thereon at prescribed intervals, opposite left and right ends of the arcuate teeth being each formed as an acute edge, and further with recesses each formed between every adjacent two of the arcuate teeth, are placed opposite to each other, and mutually eccentrically rotating eccentric rotational shafts each attached with plural sets of the crushing toothed plates are rotatably mounted on a body.

From another aspect of the present invention, there is also provided a crusher of chunks of concrete or masonry waste in which one pair of rotational shafts capable of rotation in opposite directions are disposed in parallel relation to each other within a crusher body such as a bucket or a shovel, a toothed crushing plate provided with thick teeth which are gradually increased in weight towards forward ends thereof and project radially, is fixed to each of the rotational shafts, and teeth of the crushing toothed plate fixed to one of the rotational shafts are arranged in staggered relation with teeth of the toothed crushing plate fixed to the other rotational shaft.

From a further aspect of the present invention, there is provided a crusher in which one pair of rotational shafts capable of rotation in opposite directions in synchronism with each other are mounted on a crusher body, plural sets of toothed crushing plates each having radially projecting teeth are attached to each of the rotational shafts, the crushing teeth include teeth capable of crushing upward chunks when rotated inwardly and teeth each having a sharp tip and capable of piercing through the chunks when rotated outwardly.

BEST MODE FOR CARRYING OUT THE INVENTION

Figure 1:
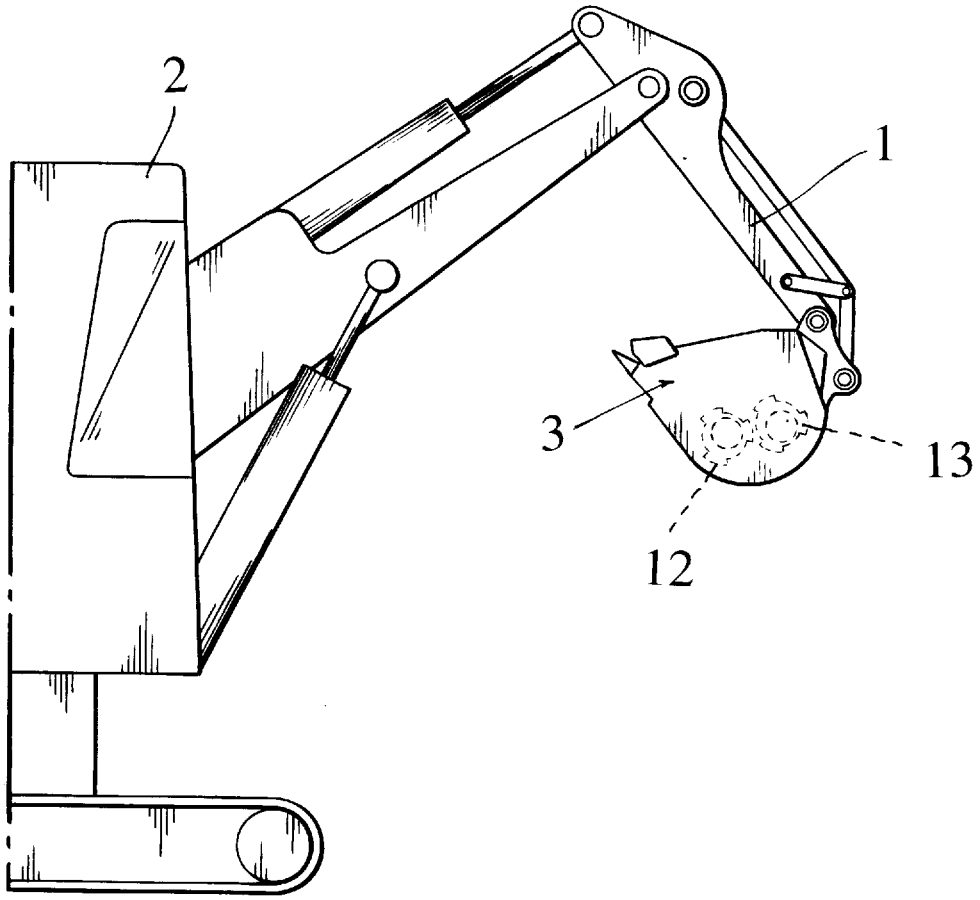
FIG. 1 is a side view of a first embodiment of the present invention in which a crusher according to the present invention is attached to a movable arm of a civil engineering machine.
Figure 2:
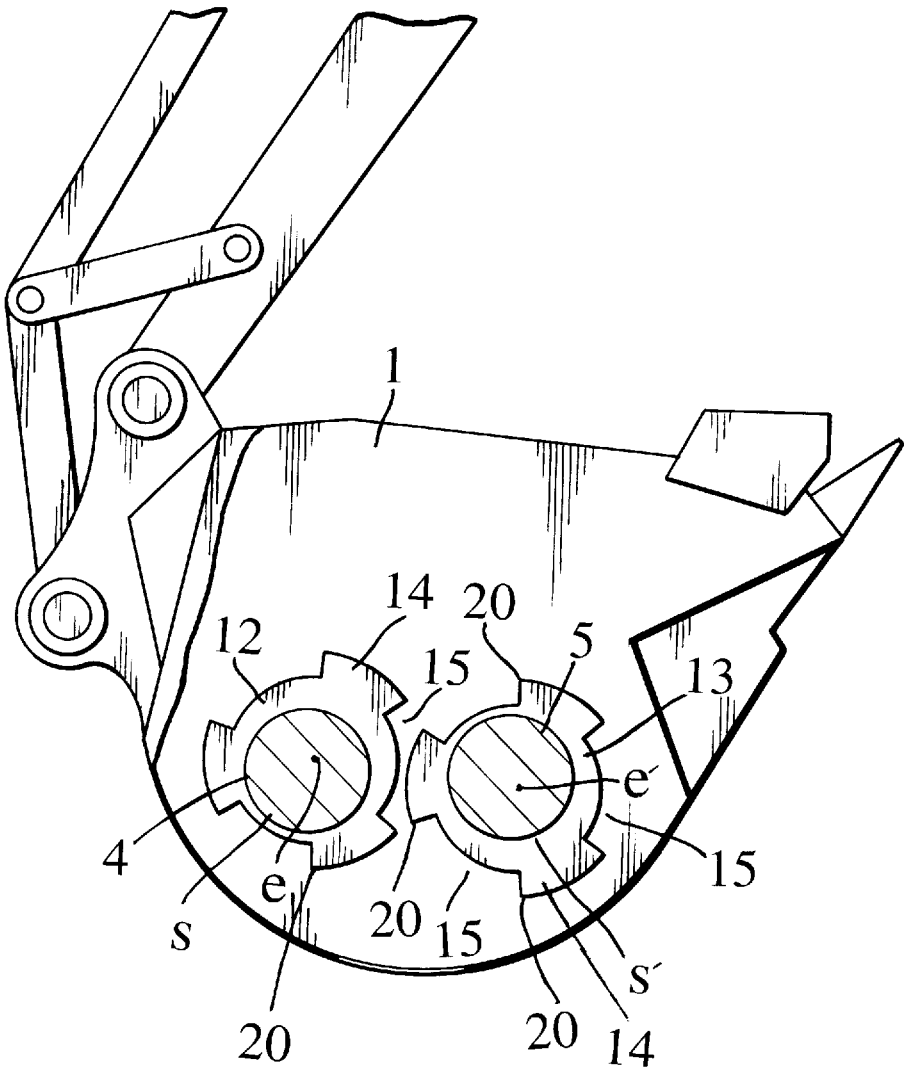
FIG. 2 is a vertical sectional side view of a crusher body.
Figure 3:
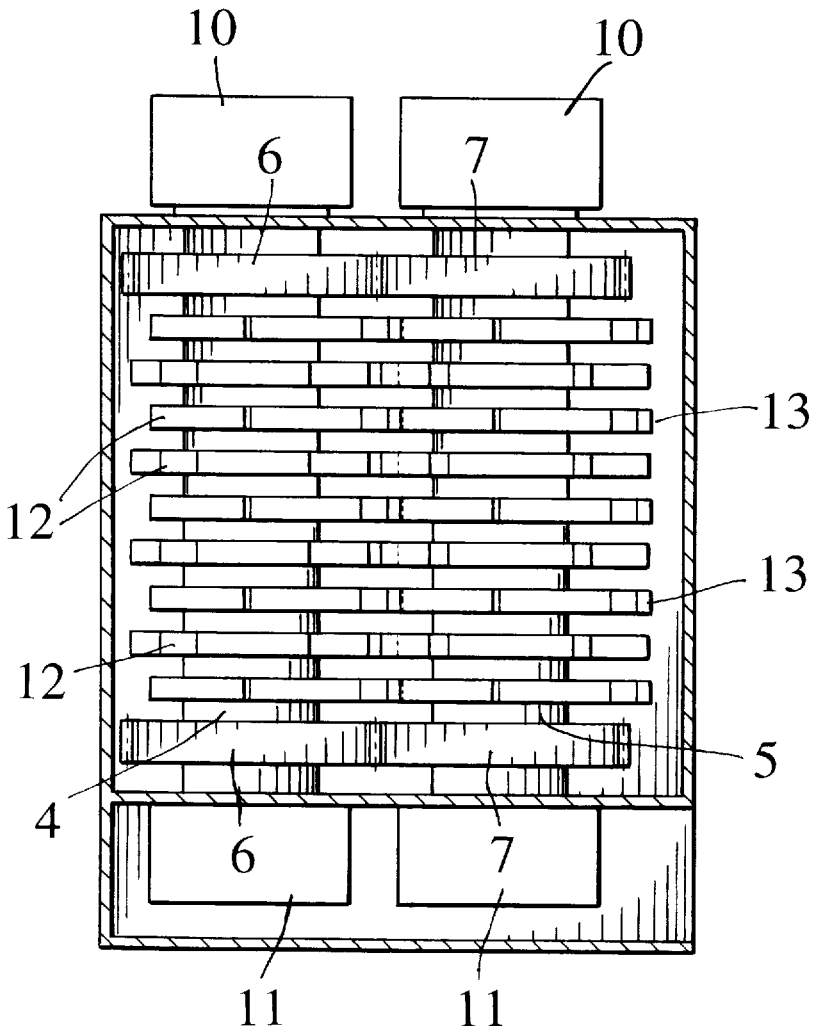
FIG. 3 is a plan view thereof, FIGS. 4(*a*), 4(*b*) is a side view showing a rotating state of toothed wheel.

FIGS. 1 through 4 show a first embodiment of the present invention. In these Figures, reference numeral 3 denotes a bucket as a crusher body which is attached to a distal end of a movable arm 1 of a civil engineering machine 2. A pair of left and right rotational shafts 4 and 5 are disposed across the bucket 3 (FIG. 2). In order to cause the rotational shafts 4 and 5 to rotate in opposite directions with respect to each other, the rotational shaft 4 is provided on opposite ends thereof each with a spur gear 6 and the other rotational shaft 5 is provided on opposite ends thereof each with a spur gear 7. Then, the rotational shafts 4 and 5 are operatively connected to oil hydraulic motors 10 and 11, respectively, so that the rotational shafts 4 and 5 are rotated in opposite directions with respect to each other in synchronism.

Figure 4A:
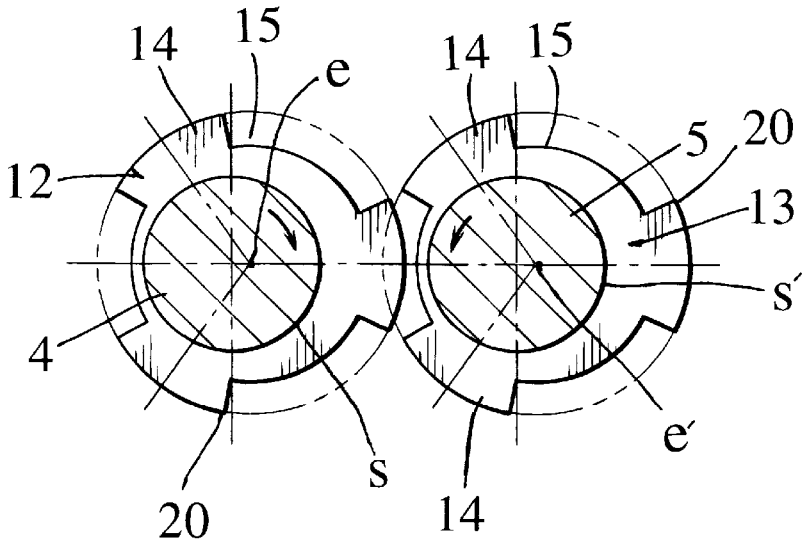
Figure 4B:
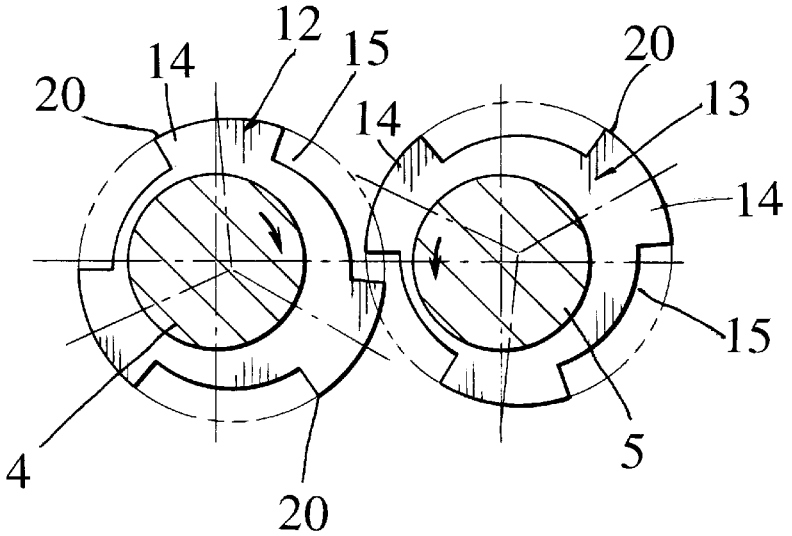
Figure 5:
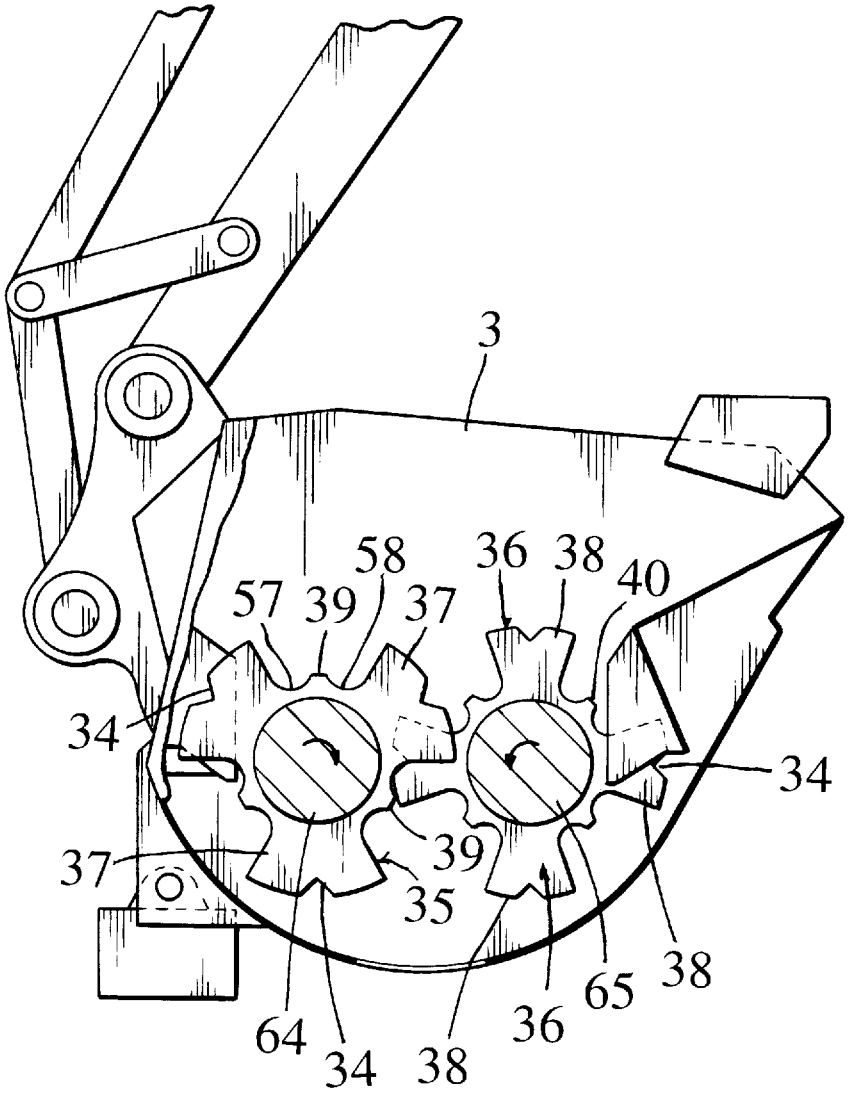
FIG. 5 is a vertical sectional side view showing a second embodiment of the present invention.

A plurality of toothed crushing plates 12 and 13 having eccentric axes e and e', which are eccentric with respect to the centers of the rotational shafts 4 and 5, are fixed respectively to the rotational shafts 4 and 5 in such a manner as to be offset in phase. As shown in FIG. 4, the toothed crushing plates 12 and 13 comprise circles S and S' having eccentric axes e and e' and the same diameters, respectively. Circumferences of the toothed crushing plates 12 and 13 are partitioned into three, respectively, so that three arcuate crushing teeth 14 project therefrom. A recess 15 is formed between every adjacent crushing teeth 14 and 14, so that the toothed crushing plate 12 (or 13) is engaged in the recess 15 of the other toothed crushing plate 13 (or 12).

Opposite left and right ends of each crushing tooth 14 are each formed into an acute edge 20, as shown in FIG. 2. Those acute edges 20 are adapted to crush chunks of waste. The directions of rotation of the rotational shafts 4 and 5 may be opposite. In case of a stationary type of crushing apparatus, no civil engineering machine is used.

With the above-mentioned construction, when the left and right rotational shafts 4 and 5 are gradually rotated in the directions as indicated by arrows of FIG. 4, the arcuate crushing teeth 14 of the crushing toothed plate 12 (or 13) enter the interior of the recesses 15 of the other crushing toothed plate 13 (or 12), respectively and continue to crush the chunks of concrete with the acute edges 20. As a consequence, a large chunk of concrete is pressurized hard by and gradually crushed with the acute edges 20. The crushing toothed plates 12 and 13 have eccentric axes and, which are eccentric with respect to the centers of the rotational shafts 4 and 5, and are fixed respectively to the rotational shafts 4 and 5 in such a manner as to be offset in phase. Owing to this particular arrangement, the scope of movement is enlarged and the crushing performance is increased. Therefore, a large chunk of concrete waste can be crushed into small pieces suited for transportation without a need of being subjected to a primary crushing and a secondary crushing.

Figure 6:
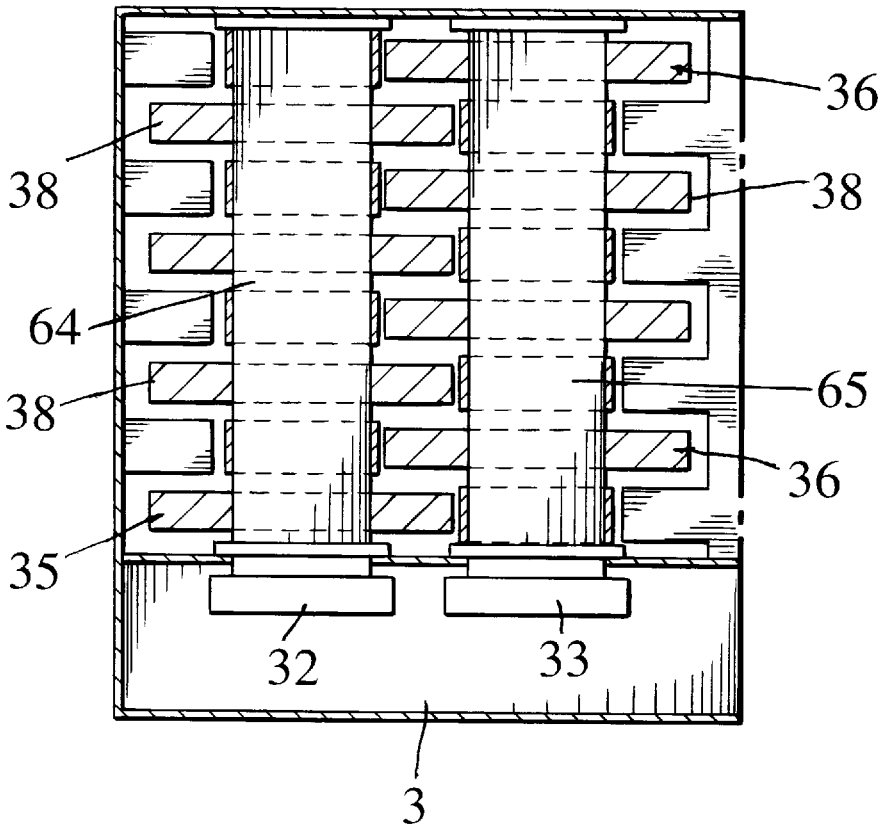
FIG. 6 is a plan view thereof.
Figure 7:
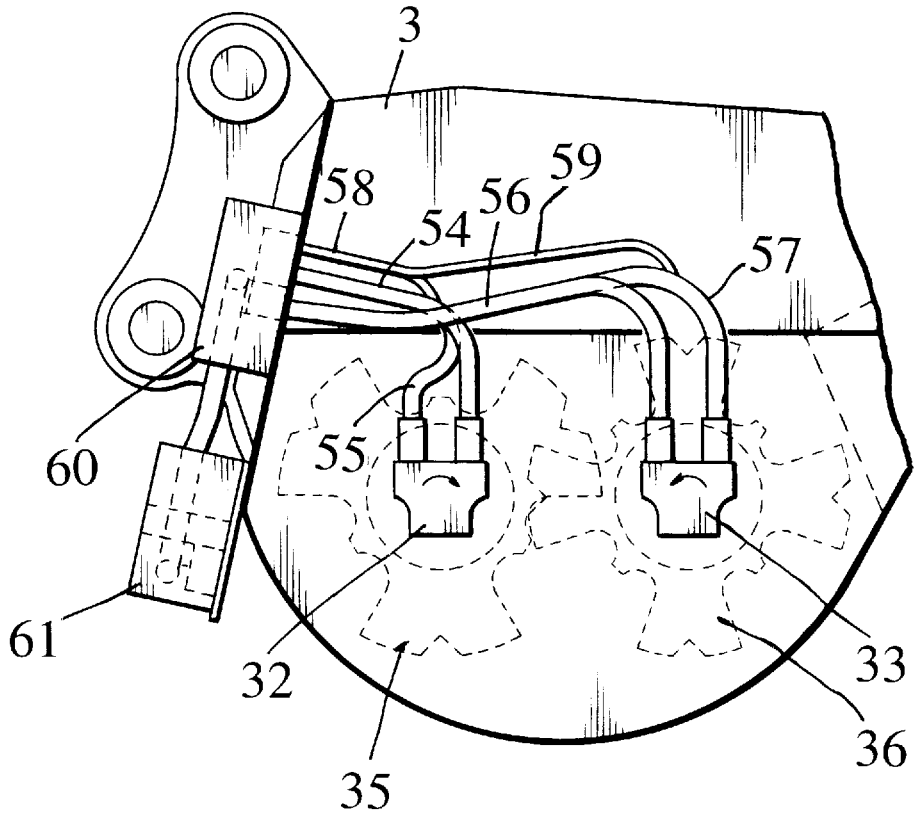
FIG. 7 is a front view showing an arrangement of oil feed hoses.
Figure 8:
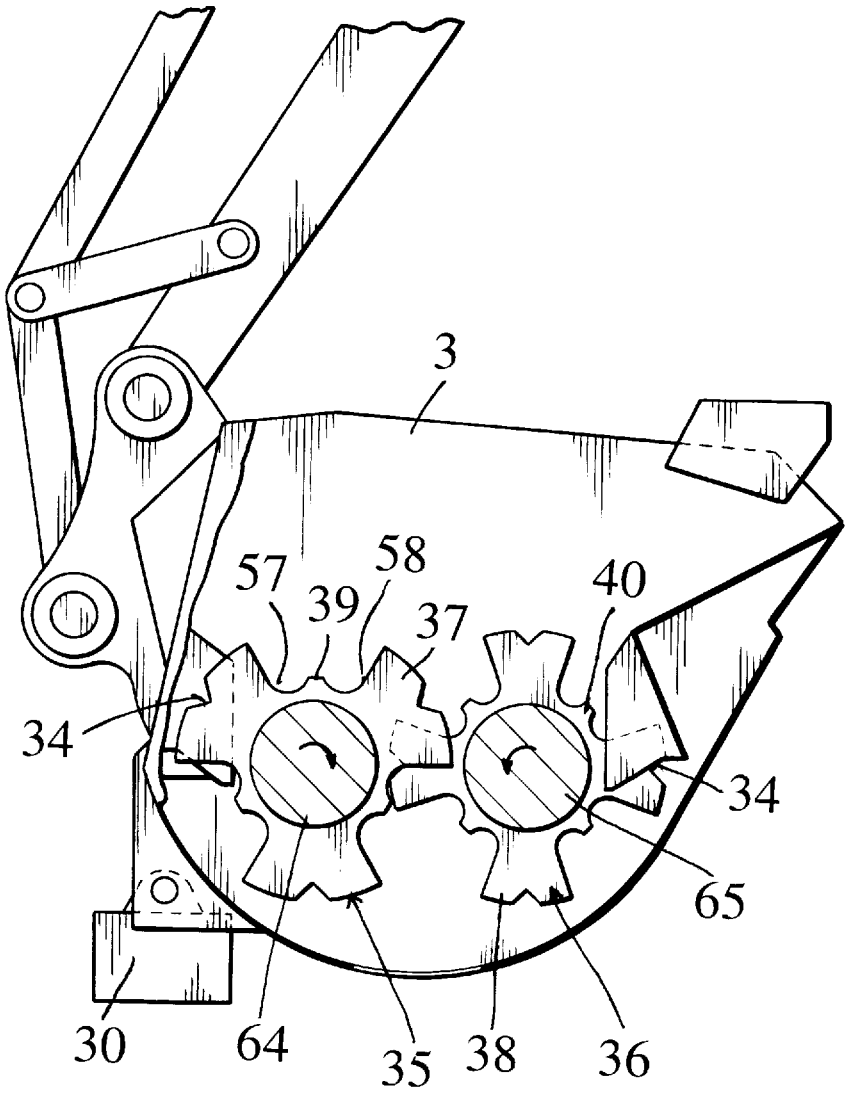
FIG. 8 is a vertical sectional side view showing a second embodiment of the present invention.
Figure 9:
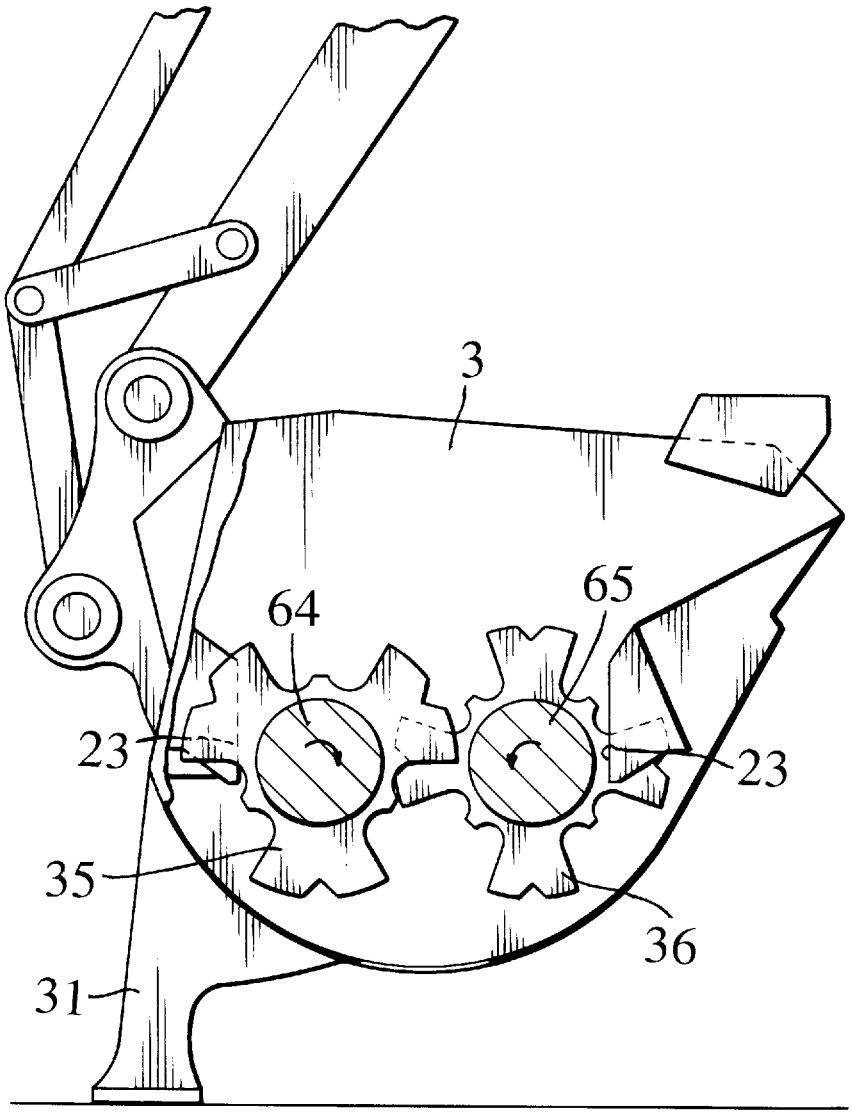
FIG. 9 is a vertical sectional side view showing a third embodiment of the present invention.
Figure 10:
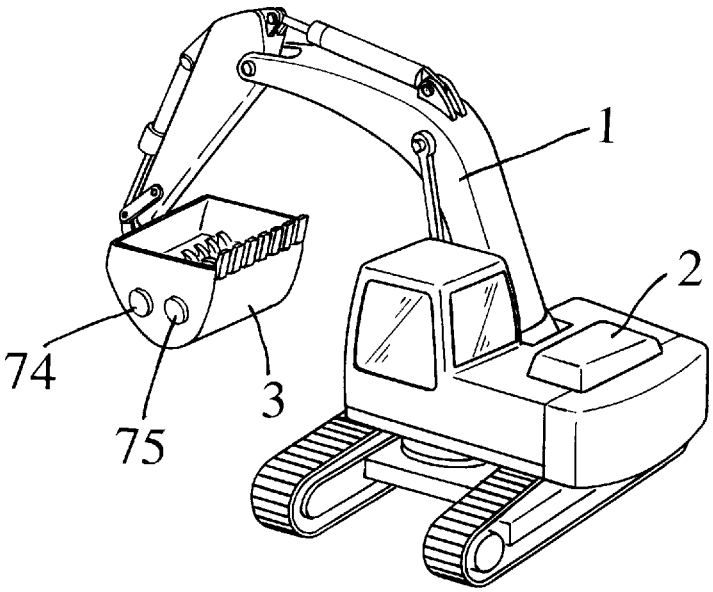
FIG. 10 is a perspective view of the third embodiment, FIGS. 11(*a*), 11(*b*), 11(*c*) is a vertical sectional side view thereof.
Figure 11A:
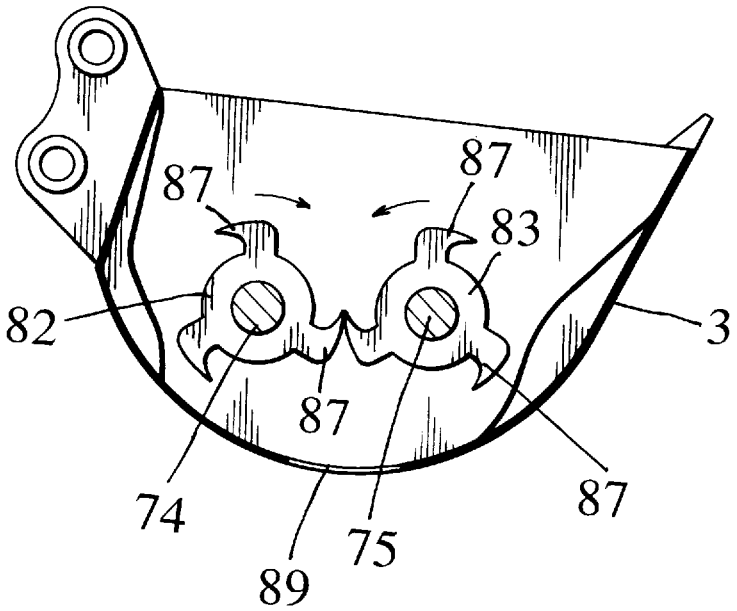
Figure 11B:
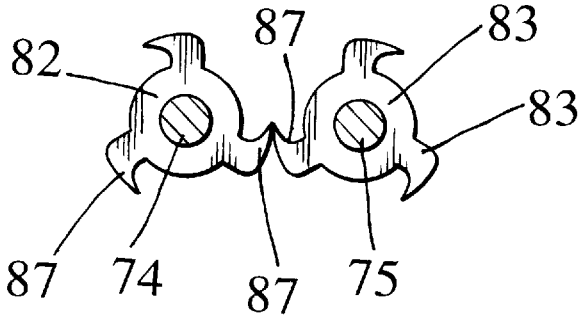
Figure 11C:
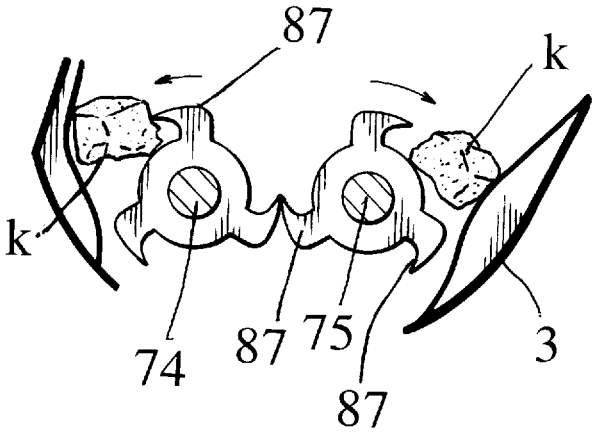
Figure 12:
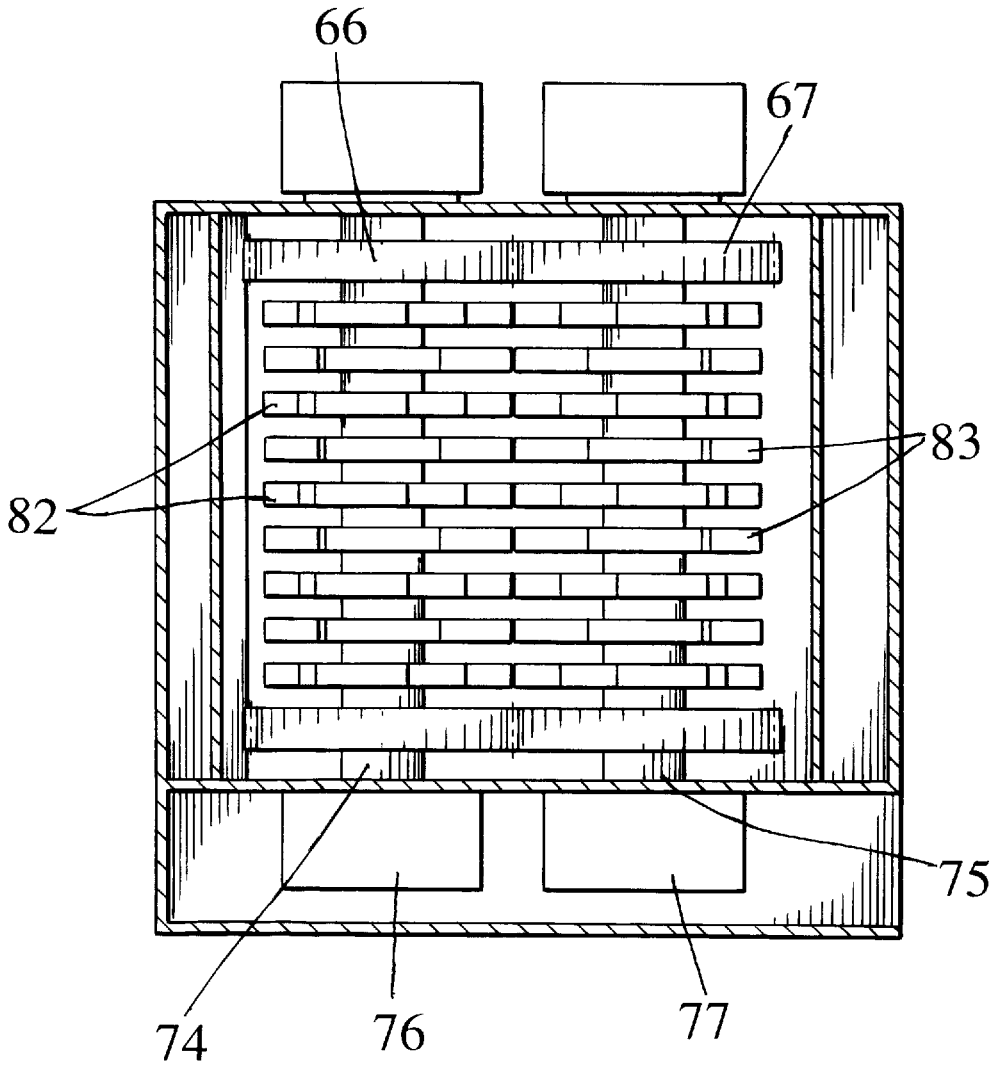
FIG. 12 is a plan view thereof.
Figure 13:
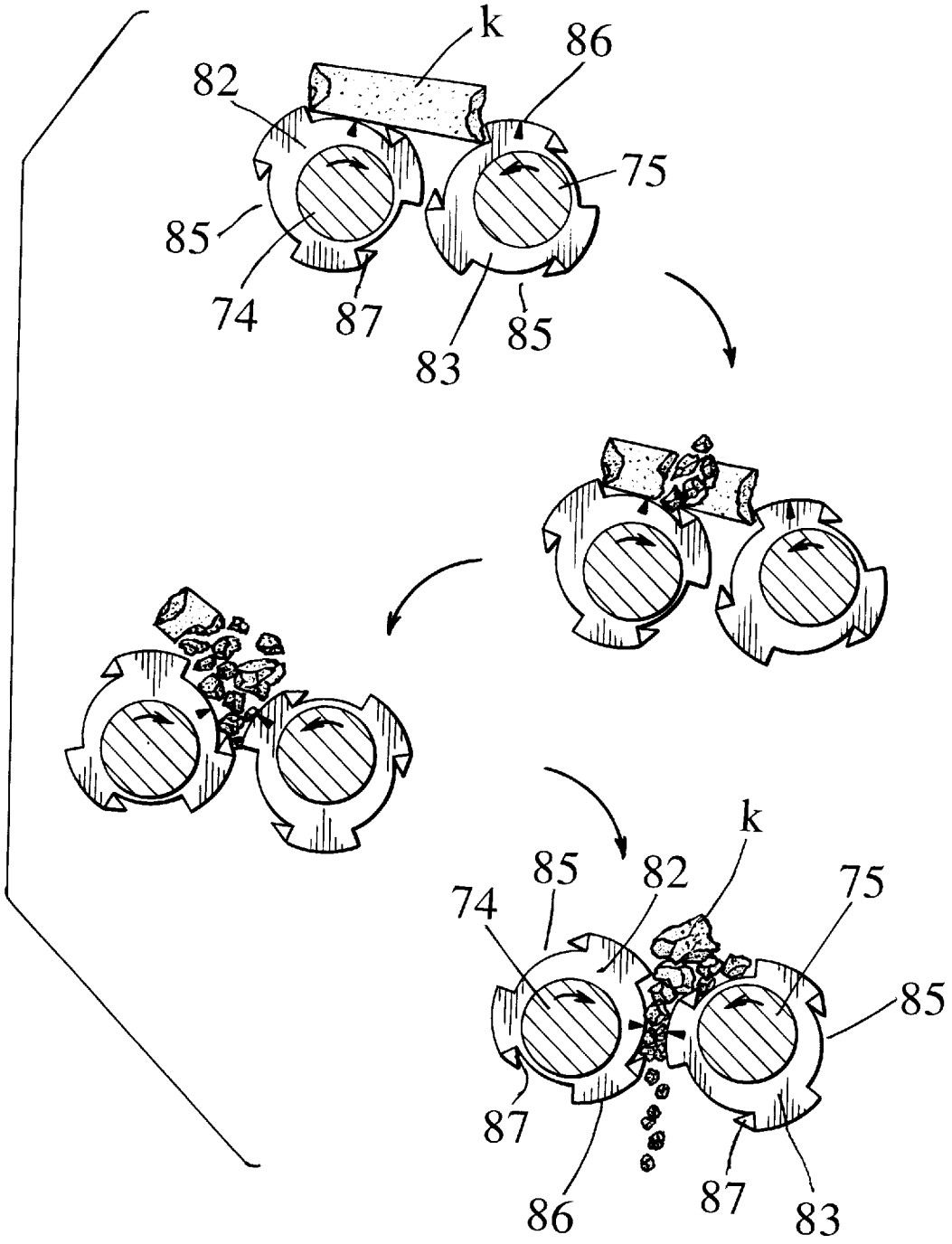
FIG. 13 is a view showing a crushing state of a chunk of concrete when a pair of rotational shafts are rotated inwardly with respect to each other.
Figure 14:
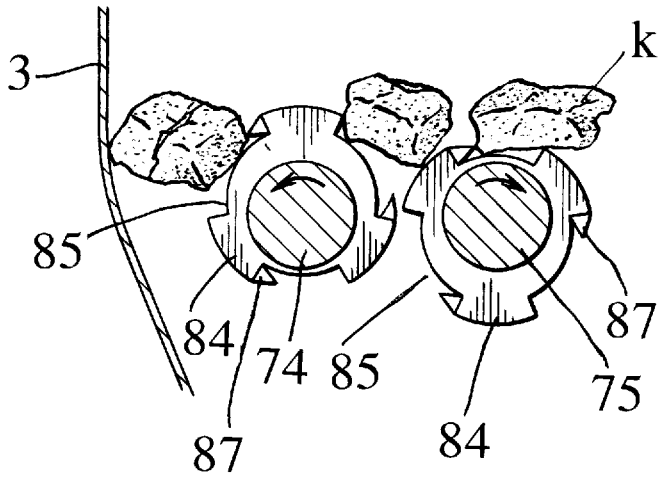
FIG. 14 is a view showing a crushing state of a chunk of concrete when a pair of rotational shafts are rotated outwardly.
Figure 15:
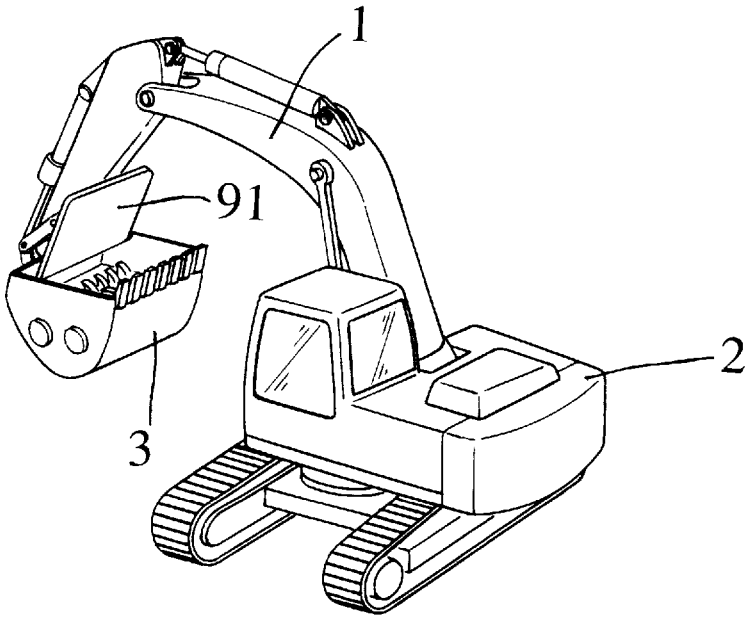
FIG. 15 is a perspective view in which a presser plate of chunks of concrete waste is attached to a crusher body.
Figure 16:
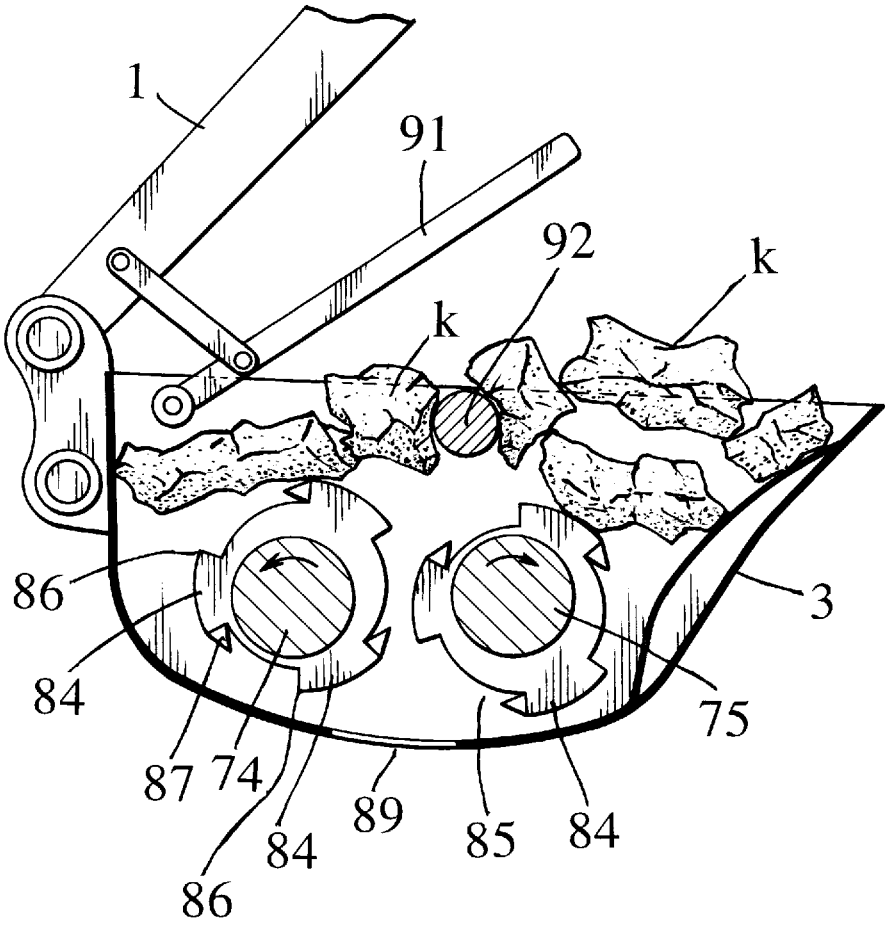
FIG. 16 is a vertical sectional side view in which a reaction rod, as well as the presser plate is attached to a crusher body.

A second embodiment of the present invention will now be described with reference to FIGS. 5 through 9. In this second embodiment, a selected one 64 of a pair of rotational shafts 64, 65 capable of rotation in opposite directions is firmly attached with a toothed crushing plate 35 provided with thick Y-shaped teeth 37 which are gradually increased in weight towards a forward end thereof and project radially, of said rotational shaft 64. The other rotational shaft 65 is firmly attached with a toothed crushing plate 36 provided with the same-shaped four teeth 38 such that the teeth 37 of the first mentioned toothed crushing plate 35 are in staggered relation with teeth 38 of the other toothed crushing plate 36. The teeth 37 and 38 of the toothed crushing plates 35 and 36 are enlarged towards forward ends thereof Between every adjacent teeth 37 and 38, recesses 57 and 58 are each formed. Chevron-like protrusions 39 and 40 are formed at intermediate parts of the recesses 57 and 58, respectively. The teeth 37 and 38 are provided at distal end faces thereof with notches 34 so as to be served as cutting edges each having an increased crushing force. The rotational shaft 64 is capable of rotating clockwise, while the other rotational shaft 65 is capable of rotating counterclockwise. For this purpose, the rotational shaft 64 of FIG. 6 is provided with an oil hydraulic motors 32 and 33 of FIG. 6 which motors 32 and 33 are mounted outside the crusher body 3, and high pressure oil feed hoses 54 and 55 and low pressure oil feed hoses 56 and 57 of FIG. 7 are in communication with a control device (not shown) located at a driving seat of the civil engineering machine body through switching devices 60 and 61. In the example shown in FIG. 8, the crusher body 3 is provided on a back thereof with a magnet absorption member 30 formed of a permanent magnet or an electromagnet in order to absorb a waste material such as an reinforcing iron bar. Effect of the electromagnet is appropriately controlled from the cabin. In case a permanent magnet is employed, there is a need of a provision of means for holding the magnet away from the chunk of waste. In the example of FIG. 9, a stabilization leg 31 is hung down from the back of the crusher body 3, so that the crusher body 3 will be stabilized during operation. Owing to this arrangement, the chunks of waste can be crushed with the toothed crushing plates which are gradually increased in weight towards forward ends thereof By doing so, the chunks of waste are no more required to be crushed after being transported to a predetermined place and therefore, no extra space for secondarily crushing the chunks of waste is needed. Reference numeral 23 denotes a back space plate.

FIGS. 10 through 16 show a third embodiment of the present invention. In this third embodiment, a pair of left and right rotational shafts 74 and 75 are pierced through and supported by the crusher body 3 such as a bucket. Opposite ends of the rotational shafts 74 and 75 are firmly attached with spur gears 66 and 67 of FIG. 12, respectively. The spur gear 66 of the rotational shaft 74 is in mesh with the spur gear 67 of the rotational shaft 75 and the rotational shafts 74 and 75 are in communication with the oil hydraulic motors 76 and 77 so that the rotational shafts 74 and 75 are rotated in opposite directions. A plurality of toothed crushing plates 82 each having a sharp piercing edge 87 are fixed to the rotational shaft 74. A corresponding number of toothed crushing plates 83 are fixed to the other rotational shaft 75. Reference numeral 84 denotes crushing teeth. The toothed crushing plates 82 and 83 of FIG. 13 each have three arcuate cutting teeth 84 formed on part of a circle and a circumference having the same diameter about eccentric axes e and e' which are offset from the center 0 of the rotational shafts 74 and 75, and three recesses 85 formed between adjacent arcuate crushing teeth 84 one of said one pair of toothed plates crushing has three teeth arranged. The arrangement being such that the crushing teeth 84 of the toothed crushing plate 82 of the rotational shaft 74 are entered into the recesses 85 of the toothed crushing plate 83 of the other rotational shaft 75.

The crushing teeth 84 of the toothed crushing plates 82 and 83 are each provided on one ends thereof with an angle tooth 86 and on the other ends thereof with a sharp piercing edge 87. When the rotational shafts 74 and 75 are rotated inwardly with respect to each other, a large chunk of concrete is crushed into small pieces between the angle teeth 86 and 86 of the crushing toothed plates 82 and 83 and then discharged outside through an opening 89 formed in a bottom of the bucket 3 as the clusher body. When the rotational shafts 74 and 75 are rotated outwardly as shown in FIG. 14(C), a large chunk of concrete contacts an outer peripheral surface of the bucket and crushed into small pieces by the sharp piercing edges 90. Then, the small pieces of concrete thus crushed are guided to between the toothed crushing plates 82 and 83 and further crushed by the sharp piercing edges 90. In the Figure, reference numeral 91 denotes a presser plate 92 for preventing the chunk of waste from bouncing upwardly, and reference numeral 92 denotes a reaction rod for preventing the chunk of waste, which would otherwise tend to escape due to rotation of the crushing teeth wheel, from escaping so that the chunk of waste is efficiently crushed by force of the crushing teeth.

I claim:

1. A crusher of chunks of waste comprising, a) frame, b) a pair of spaced and parallel shafts, each said shaft having a longitudinal axis and being supported by said frame for rotation about their longitudinal axis, c) means for rotating said shafts in opposite directions, and d) at least one toothed crushing plate fixed to each of said shafts for rotation with said shafts, each of said toothed crushing plates having a central axis and being fixed to said shafts such that the central axis of each of said toothed crushing plates is eccentrically offset from the longitudinal axis of the shaft to which said toothed crushing plate is fixed.

2. The crusher of chunks of waste as claimed in claim 1, wherein each said toothed crushing plate has at least two crushing teeth spaced by a recess, and the longitudinal axes of said shafts are spaced a predetermined amount such that one said crushing tooth of one said toothed crushing plate on one of said shafts is movable into the recess of the other said toothed crushing plate on the other of said shafts in a radial direction towards the longitudinal axis of said other shaft as said shafts rotate in opposite directions.

3. The crusher of chunks of waste as claimed in claim 2, wherein said crushing teeth on one of said shafts include opposite radial side edges and a piercing projection projecting from one of said radial side edges in a circumferential direction opposed to the direction of rotation of said shaft when said shafts are rotating in first selected opposite directions and said crushing teeth on the other said shaft have opposite radial side edges, and one of said radial side edges on the other said shaft having a projecting tooth projecting in a circumferential direction opposed to the direction of rotation of the other said shaft when said shafts are rotating in said first selected opposite directions and said piercing projection and said projecting tooth projecting in the direction of rotation of said shafts when said shafts rotate in second selected opposite directions.

4. The crusher of chunks of waste as claimed in claim 1, wherein each said toothed crushing plate has at least two crushing teeth having radially outer crushing surfaces, and said crushing teeth are spaced by a recess having a convex recess floor, and the longitudinal axes of said shafts are spaced a predetermined amount such that the convex recess floor of one said toothed crushing plate on one of said shafts is movable against the crushing surface of one of the crushing teeth of the other said toothed crushing plate on the other of said shafts in a radial direction towards the longitudinal axis of said other shaft as said shafts rotate in opposite directions.

5. The crusher of chunks of waste as claimed in claim 1, wherein each of said toothed crushing plates include a plurality of said crushing teeth arranged such that the crushing teeth of each toothed crushing plate are alternately offset in phase during rotation of said shafts by said means for rotating said shafts in opposite directions.

6. The crusher of chunks of waste as claimed in claim 1, wherein said crushing teeth have a radially outer crushing surface, and said crushing teeth are spaced by a recess, and said crushing teeth increase in circumferential width about said central axis in a radial direction from the central axis toward the crushing surface.

7. The crusher of chunks of waste as claimed in claim 6, wherein each of said crushing teeth has a notch formed in the crushing surface such that said crushing teeth have a Y-shaped form.

8. The crusher of chunks of waste as claimed in claim 1, wherein said toothed crushing plates are arranged on said shafts to travel along intersecting travel paths.

9. The crusher of chunks of waste as claimed in claim 8, wherein the toothed crushing plates on each said shaft, when arranged to travel along intersecting travel paths have the same number of crushing teeth.

10. The crusher of chunks of waste as claimed in claim 1, wherein said toothed crushing plates are arranged on said shafts to travel along non-intersecting travel paths.

11. The crusher of chunks of waste as claimed in claim 10, wherein one of the toothed crushing plates on one of said shafts has an odd number of crushing teeth and the other of said tooth crushing plates has an even number of crushing teeth when said tooth crushing plates are arranged to travel along said non-intersecting travel paths.

12. The crusher of chunks of waste as claimed in claim 1 further including a reaction rod supported on said frame parallel to said shafts and above said shafts to cooperate with said rotating shafts to direct chunks of waste between the rotating shafts and the reaction rod.

13. The crusher of chunks of waste as claimed in claim 1 further including a presser plate having opposite side edges, one of said side edges being pivoted to said frame for movement toward said shafts to form a cover for said frame that prevents chunks of waste from bouncing out of said frame during rotation of said shafts in said opposite directions.

* * * * *